US005208895A

United States Patent [19]

Hoover, Jr. et al.

[11] Patent Number: 5,208,895

[45] Date of Patent: May 4, 1993

[54] COMBINATION HEATED SCRAPER AND STEAMER

[76] Inventors: Joseph R. Hoover, Jr.; Chellie S. Hoover, both of 224 Silverwood Way, El Paso, Tex. 79922

[21] Appl. No.: 802,898

[22] Filed: Dec. 6, 1991

[51] Int. Cl.[5] ..... D06F 75/10; F22B 1/28

[52] U.S. Cl. ..... 392/404; 219/229; 392/406

[58] Field of Search ..... 392/404, 394, 402, 403, 392/405, 406, 384, 385, 396; 219/227, 229

[56] References Cited

U.S. PATENT DOCUMENTS

| | | | |
|---|---|---|---|
| 1,674,237 | 6/1928 | Bauer | 401/22 |
| 1,947,857 | 2/1934 | Krebs | 392/402 |
| 2,062,998 | 12/1936 | Peterson | 219/227 |
| 2,481,760 | 9/1949 | Leher | 392/476 |
| 2,849,736 | 9/1958 | Kohle | 392/404 |
| 2,998,924 | 9/1961 | Schaeffer | 392/396 |
| 3,082,467 | 3/1963 | Wells | 392/396 |
| 3,258,578 | 6/1966 | Ferris | 392/404 |
| 3,584,965 | 6/1971 | Chastanier | 392/396 |
| 3,690,024 | 9/1972 | Osrow | 392/404 |
| 4,835,364 | 5/1989 | Wilkins | 392/404 |

FOREIGN PATENT DOCUMENTS

| | | | |
|---|---|---|---|
| 886351 | 9/1951 | Fed. Rep. of Germany | 219/229 |
| 689055 | 3/1953 | United Kingdom | 219/229 |

*Primary Examiner*—Teresa J. Walberg

*Attorney, Agent, or Firm*—Deborah A. Peacock; Jeffrey D. Myers; Dennis F. Armijo

[57] ABSTRACT

A hand-held heated scraper with steaming capabilities for use in removing paint, wallpaper, and adhesively glued down materials (such as linoleum or tile). The apparatus includes a housing accommodating a heating unit and steam generator, an electric water pump, and two alternative base units for attaching a scraper blade, communicating steam to a work surface, or both.

10 Claims, 6 Drawing Sheets

COMBINATION HEATED SCRAPER AND STEAMER

BACKGROUND OF THE INVENTION

1. Field of the Invention (Technical Field)

This invention relates to hand-held heated scrapers, unheated scrapers, powered paint removers, wallpaper steamers, adhesive removers, heat guns, and chemical removers. The above items are used to remove paint type materials from home exteriors and interiors and furniture, and to remove wallpaper, shelving paper, and coverings secured to a surface by an adhesive softenable by heat, moisture, or both.

2. Background Art

Heated scrapers are known in the art, but have not heretofore been combined with steam to be used in the removal of paint and adhesives. The most common means of removing these items has been by using electrically-powered paint scrapers, chemicals and heat guns. All of the above require additional tools such as putty knives or other scraping devices. This requires the user to have tools in both hands to complete a project, or to put down one tool and pick up another to complete the project.

Steamers are known in the art, but have never been entirely satisfactory. "On-board" water tanks have been used, but their water capacities are limited and the tank must be continually refilled. If the tank is too large, the unit becomes heavy and the user becomes tired. Furthermore, to remove the material from the work surface, the steamer must be put down and a different scraping device employed to complete the removal of the material. Where separate tanks have been used, they have been limited to tanks specifically designed for use with the particular steamer. In most cases, water is heated by an electric heater to produce steam and the electrical rating of the heater also affects the period of time for which the steamer can be used. The electrical rating of the heater must also be such that the steamer can be powered from a domestic power supply.

It has heretofore been unknown in the art to combine a heated scraping blade and steam in one hand-held unit, thereby providing the user with a free hand to assist in completing a project. Such combination, disclosed herein, is more effective and efficient in removing paint, coverings secured to a surface by heat and/or moisture softenable adhesives, wall paper, shelving paper, glued-down cloth, and synthetic materials.

SUMMARY OF THE INVENTION (DISCLOSURE OF THE INVENTION)

The present invention is of a heated scraper and steamer apparatus comprising: a housing; a heat and steam unit within the housing; a unit for attaching a heat conductive blade to the apparatus; a unit for conducting steam produced by the heat and steam producing means to a work surface; and a unit for conducting heat to the blade and to the work surface via the blade. In the preferred embodiment, the heat and steam unit is capable of alternatively producing heat only or heat and steam simultaneously, comprises a temperature regulator, and also is capable of superheating steam. The apparatus additionally comprises a three-way switch disposed on the housing and electrically connected to the heat and steam producing unit, whereby the heat and steam producing unit is settable to a first position to turn off the apparatus, settable to a second position to provide heat only, and settable to a third position to provide heat and steam simultaneously. A water pump is disposed within the housing and operably connected to the heat and steam producing unit and to a water supply external to the housing. The steam conducting unit is disposed within the blade attaching unit. Two such combined units are provided: one wherein steam is conducted parallel to the longitudinal dimension of and to a point near an end of the housing, and the other wherein the steam is conducted in a plurality of directions from the underside of the housing. The apparatus additionally comprises a dowel attached to the heat and steam producing unit for preventing motion of the blade attached to the apparatus.

The present invention is also of a heated-blade scraper apparatus comprising: a housing; a heat producing unit within the housing; a heat conductive blade; and a unit for attaching the blade to the heat producing unit, the attaching unit comprising a plurality of nipples and grommets. In the preferred embodiment, the heat producing unit comprises a temperature regulator and has a dowel for preventing blade motion attached thereto.

The present invention is also of a steamer apparatus, for conducting steam to a work surface, comprising: a housing; a unit for producing steam within the housing; a water supply line to supply water stored external to the apparatus to the steam producing unit; a unit for conducting steam to a work surface; and a unit for communicating steam from the steam producing unit to the steam conducting unit, the communicating unit comprising a fastener for securely fastening the steam producing means to the steam conducting means. In the preferred embodiment, the steam producing unit produces superheated steam and comprises a temperature regulator. The communicating unit comprises a plurality of nipples and grommets.

The present invention is further of a method of stripping material from a surface comprising: attaching a scraper blade to a scraper and steamer apparatus; heating the scraper blade; and stripping the material from the surface with the heated blade. Preferably, steam is provided to the surface simultaneously with heating of the scraper blade.

A primary object of the present invention is to provide an apparatus combining the advantages of heated scrapers and steamers.

Another object of the present invention is to provide a light-weight steamer apparatus that may be wielded with a single hand.

An advantage of the present invention is that it is environmentally safe in that it eliminates the need for toxic chemicals or open flames.

Another advantage of the present invention is that when a mistake is made in securing items to a surface, the worker can mend the portion of the surface where the mistake occurred rather than beginning anew.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

Figure 1:
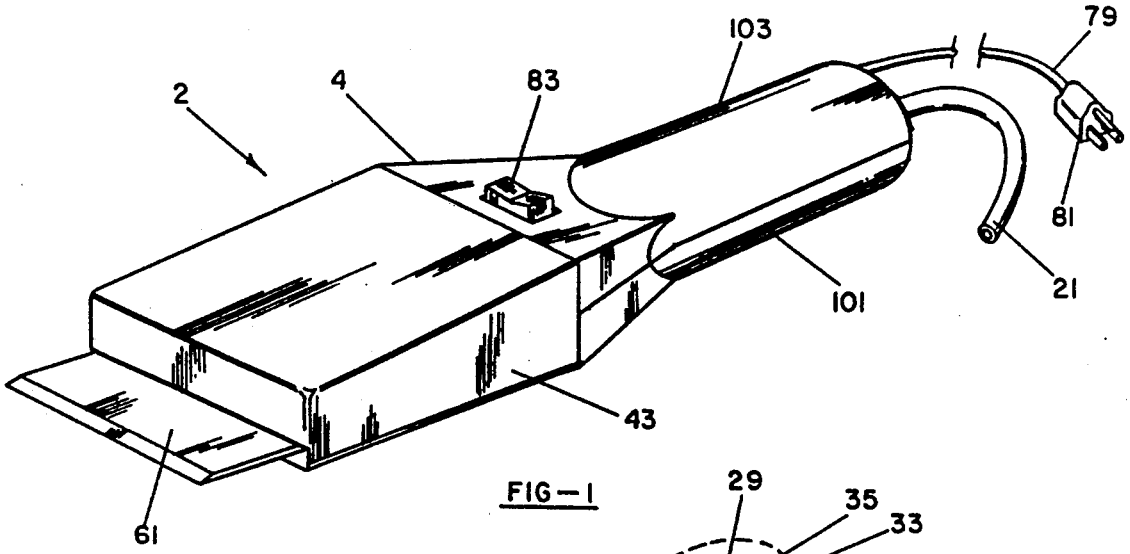
FIG. 1 is a perspective view of the preferred embodiment of the present invention.

DESCRIPTION OF THE PREFERRED EMBODIMENTS (BEST MODES FOR CARRYING OUT THE INVENTION)

The present invention provides a hand-held apparatus for scraping, with a heated or unheated blade, for steaming, and for a combination of scraping and steaming. It may be used to remove a wide variety of substances from a wide variety of surfaces, including paint-type materials from home exteriors and interiors and furniture, and wallpaper, shelving paper, and coverings from surfaces adhered to by an adhesive softenable by heat, moisture, or both.

In the preferred embodiment of the present invention, as pictured in FIGS. 1–4, a hand-held blade-heatable scraper and steam-producing apparatus 2 comprises housing 4 with base unit 43 which supports heat/steam generator 1. Tubular electrical resistance heater 5 provides heat to blade 61 and to heat/steam generator 1, which generates steam after water contained therein is heated. Blade 61 is disposed underneath heat/steam generator 1, which is disposed underneath housing 4. Steam is channeled to base unit 43 via nozzles 19 and nozzle nipples 41, which are covered by heat-resistant rubber grommets 39, permitting an intimate leak-proof fit when placed in recess holes 47 within base unit 43.

Figure 2:
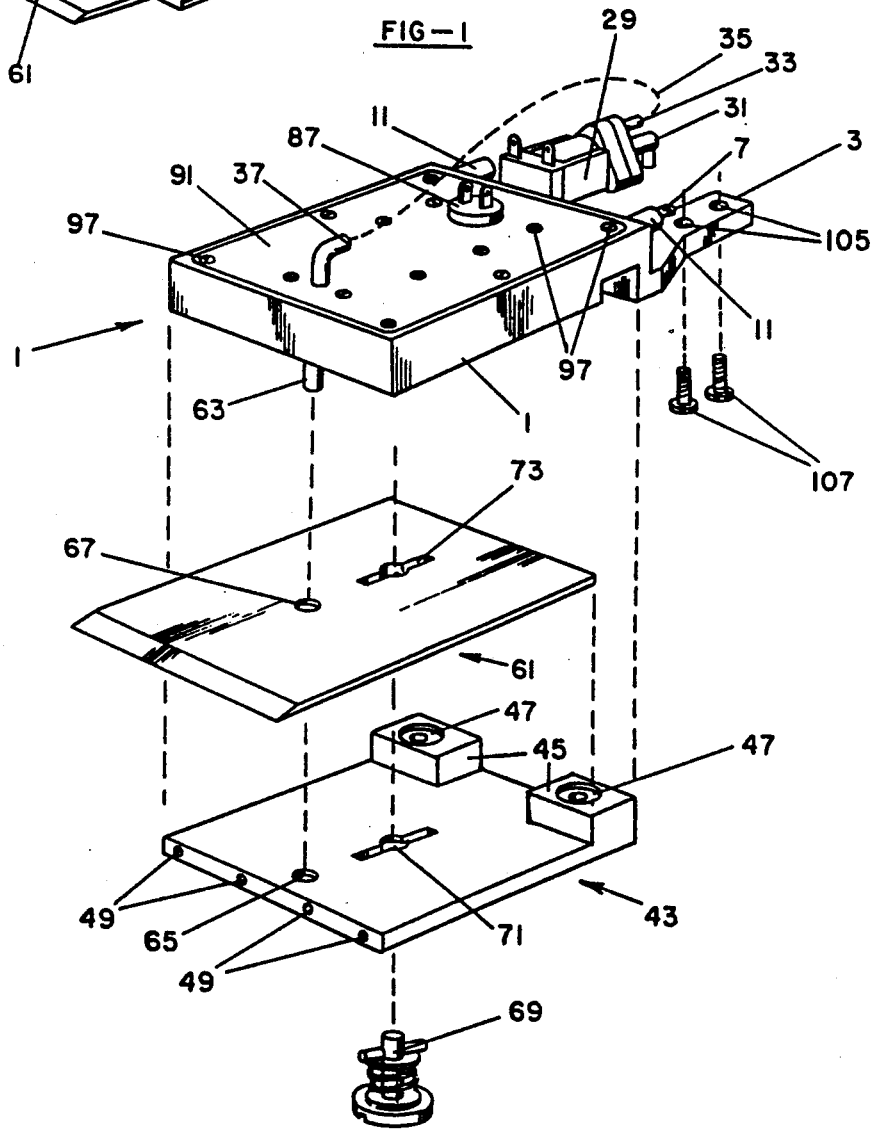
FIG. 2 is a disassembled exploded perspective view of the preferred embodiment.
Figure 5:
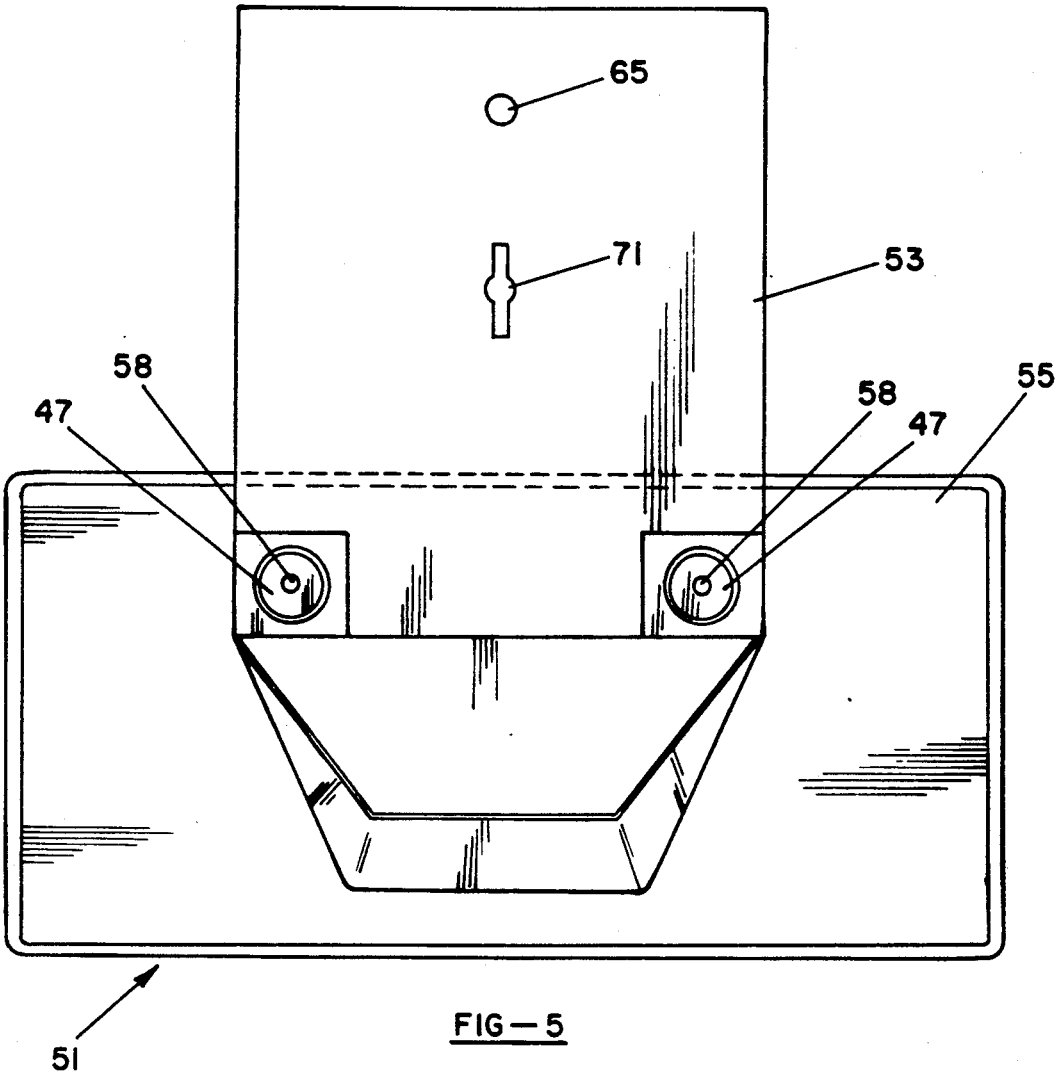
FIG. 5 is a top view of a blade mounting base and steam manifold embodiment of the invention.
Figure 6:
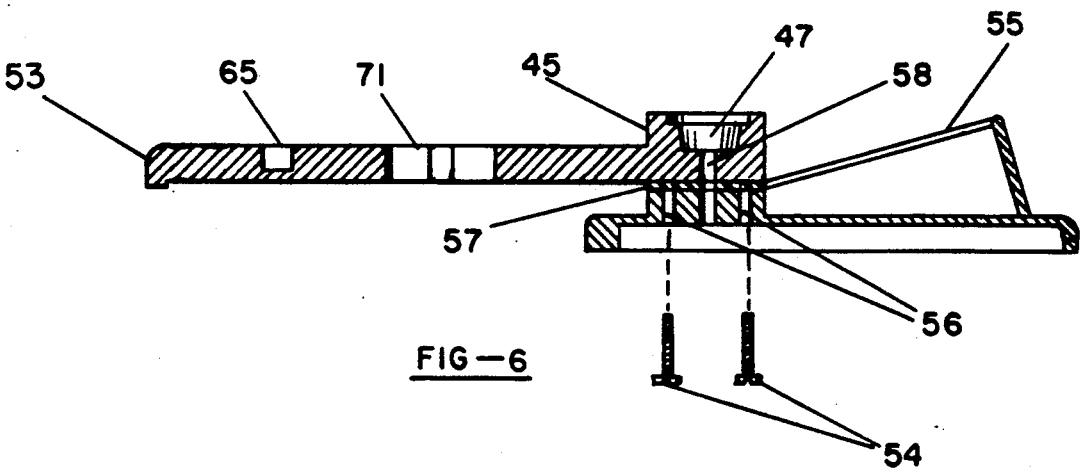
FIG. 6 is a side cut-away view of a blade mounting base and steam manifold embodiment of the invention.
Figure 4:
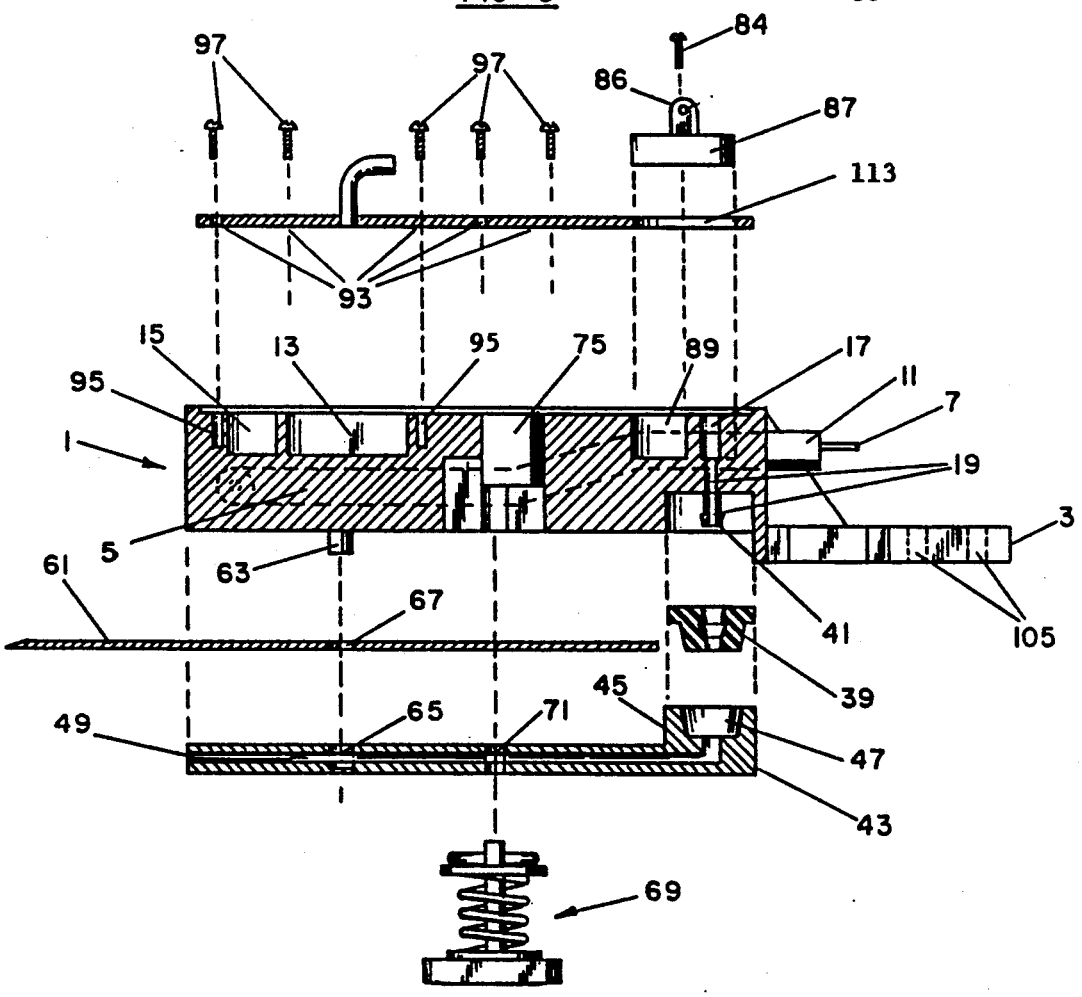
FIG. 4 is a side exploded cut-away view of the preferred embodiment.
Figure 7:
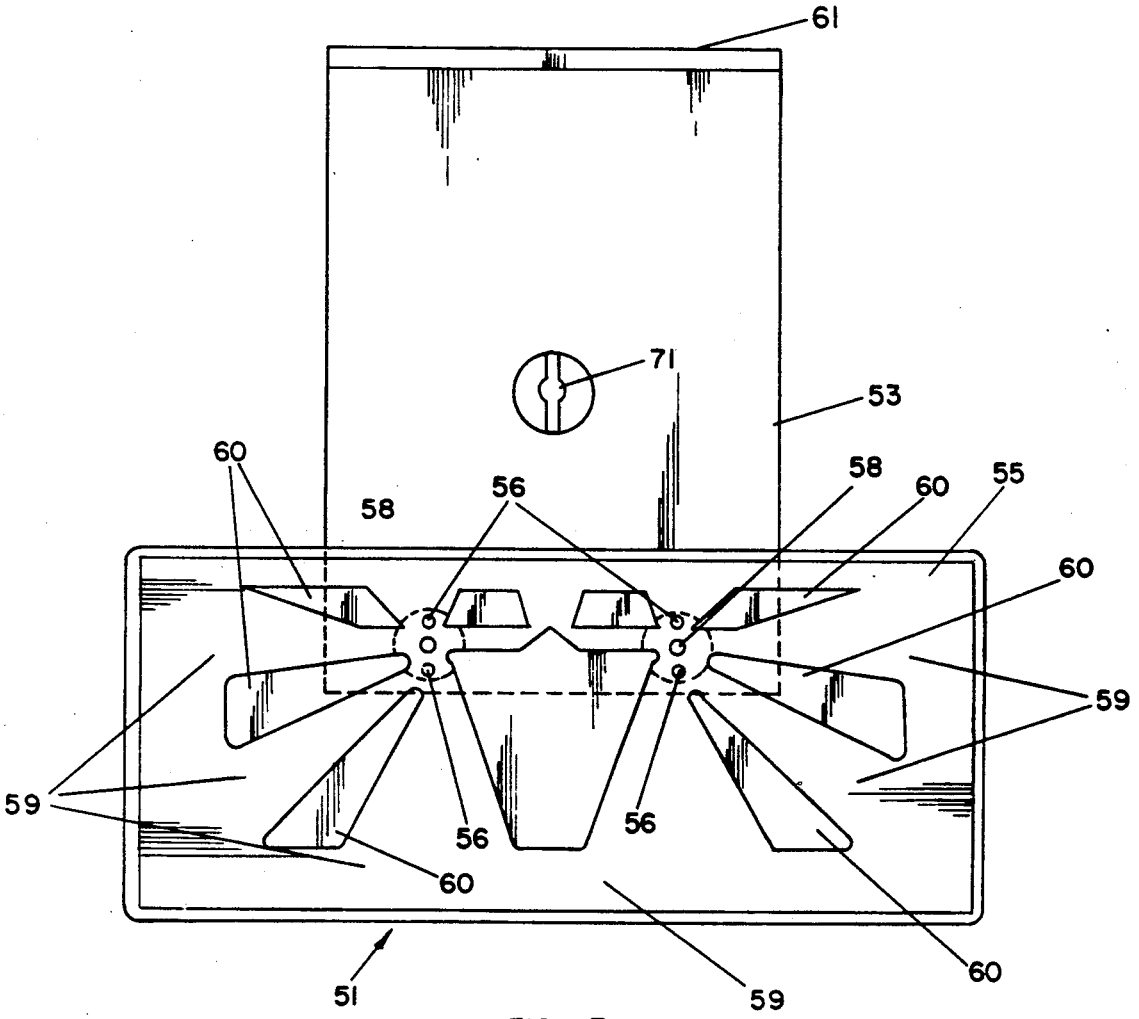
FIG. 7 is a bottom view of a blade mounting base and steam manifold embodiment of the invention.
Figure 8:
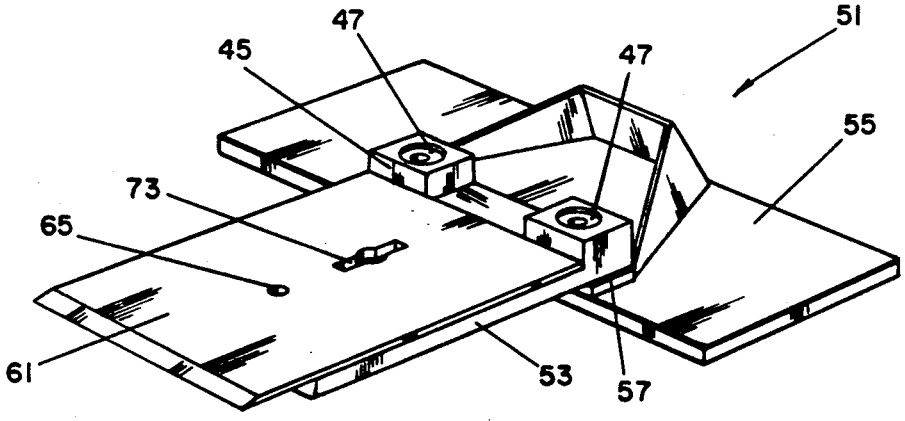
FIG. 8 is a perspective view of a blade mounting base and steam manifold embodiment of the invention.

There are two ways in which steam may be provided to a surface (e.g., a wall surface), each of which requires a different base attached to heat/steam generator 1. In one embodiment, as illustrated in FIGS. 2 and 4, heat/steam generator 1 has grommets 39 which fit intimately into recessed holes 47 within base unit 43. Steam is channeled therethrough and through base unit 43 via steam channels 49 and exits parallel to blade 61. In an alternative embodiment, illustrated in FIGS. 5–8, blade mounting base and steam manifold 51 has recessed holes 47 into which fit intimately grommets 39 attached to heat/steam generator 1. Steam is channeled therethrough via steam nozzles 58 into steam paths 59 within steam manifold 55, whereby the exiting steam saturates and distributes evenly into and upon the surface being worked upon. In both embodiments, the steam is channeled to the bases in the same manner, but the distribution of the steam by the bases differs. In both embodiments, blade 61 is removably attachable and various sized and shaped blades can be used with either base unit 43 or blade mounting base and steam manifold 51.

Figure 10:
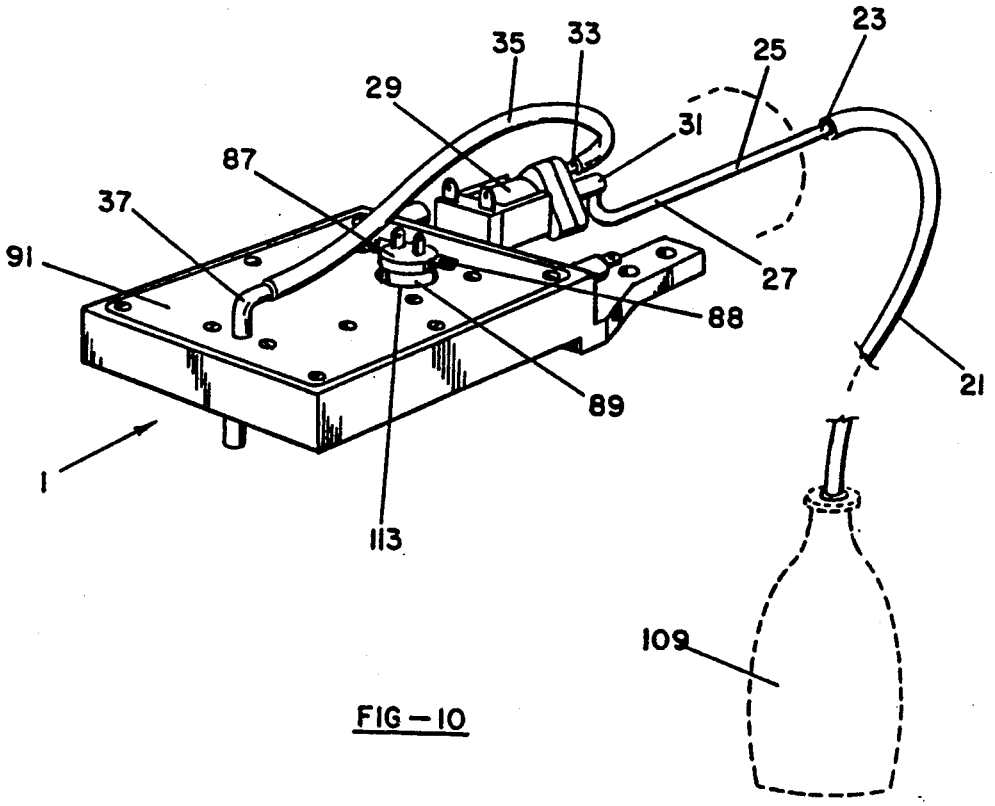
FIG. 10 is a perspective view of steam generation elements of the preferred embodiment.

Water is supplied to the invention from a water container 109, as illustrated in FIG. 10. Water container 109 can be of varying capacities, can be attachable to the user's waist by a belt, attachable to the user's back by use of a back-supported frame, placed on the ground, or the like. An electrically powered water pump 29 is located in housing 4, and connects with water container 109 via unencased water inlet line 21, unencased line coupling 23, encased line coupling 25, encased water inlet line 27, and water pump inlet 31, and connects to heat/steam generator 1 via water pump outlet 33, water outlet line 35, and flash steam reservoir nozzle 37. The pump has a pumping rate of about 20–33 cc per minute.

Figure 3:
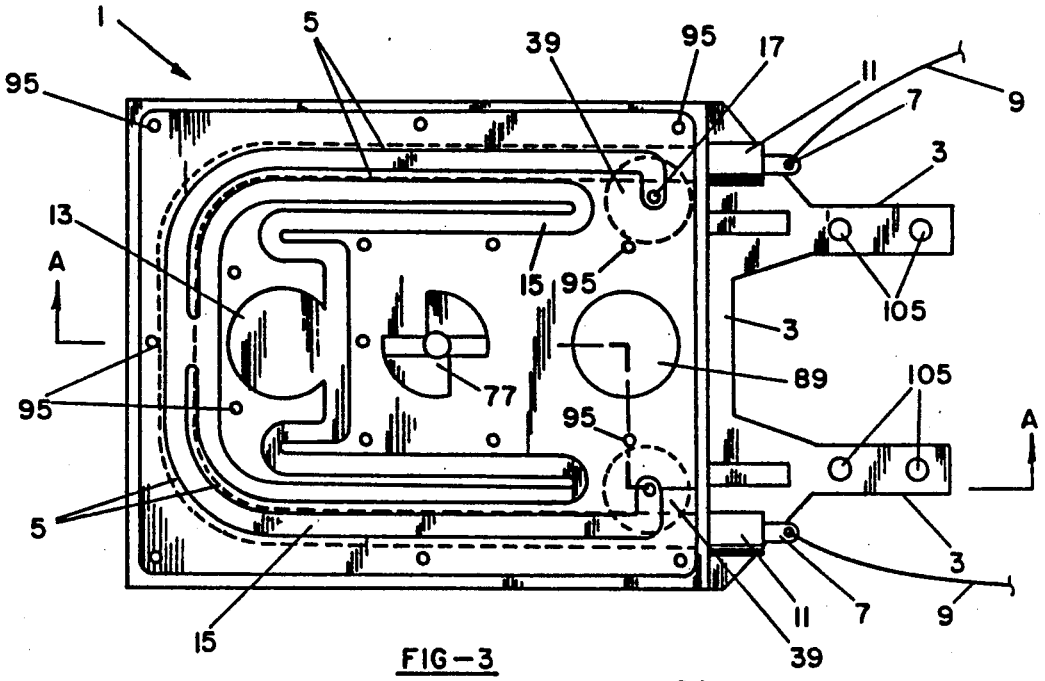
FIG. 3 is a top view of a heat/steam generator element of the preferred embodiment.
Figure 11:
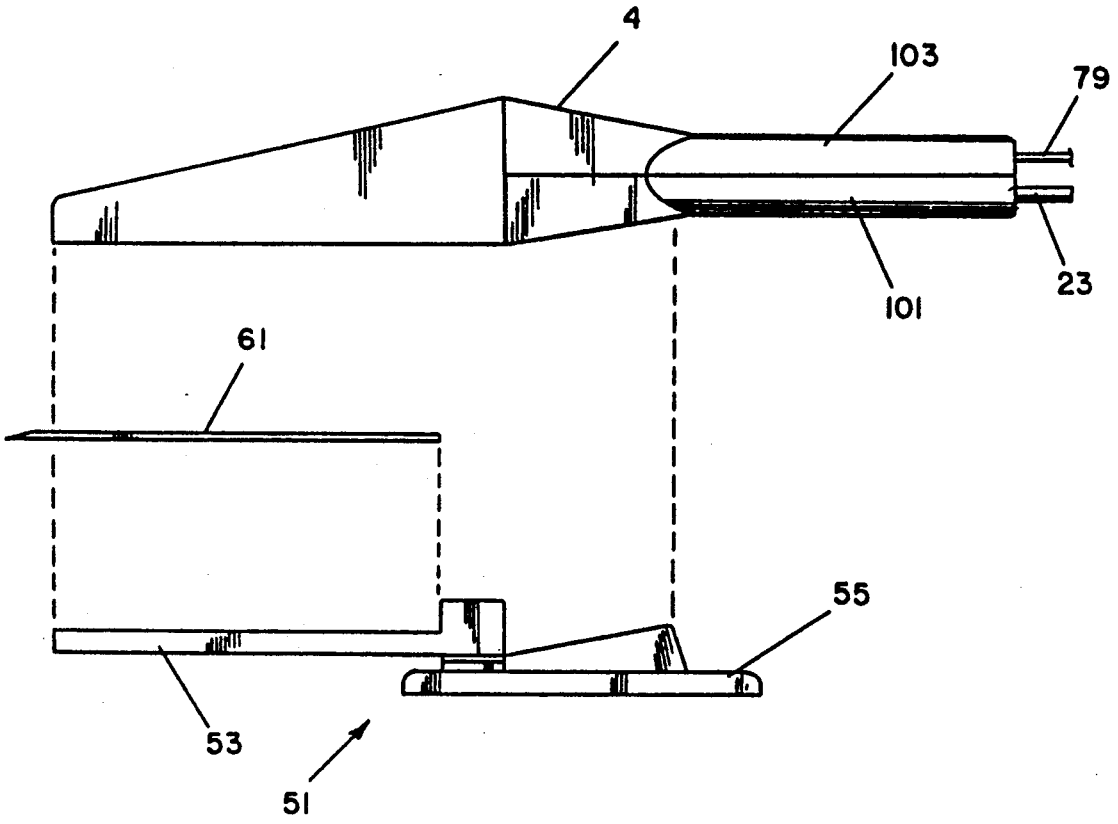
FIG. 11 is a side view of a blade mounting base and steam manifold embodiment of the invention.

As illustrated in FIGS. 2–4, base unit 43 and blade 61 are attached to heat/steam generator 1 by inserting locking screw 69, preferably a ¼-turn set screw, through base unit screw hole 71, blade screw hole 73, and generator screw hole 75, and into screw lock 77. Blade mounting base and steam manifold 51 may be used rather than base unit 43, as seen in FIG. 11.

As illustrated in FIG. 3, heat/steam generator 1 is of generally rectangular form when viewed from above. It preferably has a body of a durable high-heat-conductive material (e.g., light metal alloy or ceramic). Cast integrally with and projecting from the rear are two handle mounting prongs 3, preferably internally cast of rigid non-heat conductive material.

Tubular electrical resistance heater 5 is integrally cast with heat/steam generator 1 and heats the generator to a temperature sufficient to produce steam and/or to radiate heat to an attached blade 61. Heater 5 is preferably of a "U" shape and rated at 1.2 kW to 1.4 kW. There are two electrical connectors 7, one on each end of the "U" of heater 5. Electrical connectors 7 are not cast into the body of heat/steam generator 1 but are left exposed at the rear of the generator. Heat resistant insulators 11 are placed between the body of the generator and the tip of each electrical connector 7. Electric current is supplied via a series of heat-resistant insulated wires 9, a 3-way switch 83 (illustrated in FIG. 1), and a heat sensitive temperature controlling device 87 (illustrated in FIG. 2).

Other features of heat/steam generator 1 (for example, handle mounting prongs 3, flash steam producing reservoir 13, steam channels 15, steam exit holes 17, and heat-sensitive temperature controlling device receptacle 89) are formed when the generator is cast. Flash steam producing reservoir 13 and steam channels 15 are cast integrally with the body of the generator. Flash steam producing reservoir 13 is preferably located towards the front of the generator and two steam channels 15 start at the reservoir and route steam produced in the reservoir in a circuitous pattern. The pattern is designed to pass steam over the hottest part of the generator so that it superheats the steam as it travels to steam exit holes 17 at the top rear of the generator.

Hollow steam nozzles 19 protrude from the bottom rear of the generator and direct steam through steam nozzle nipples 41 covered by grommets 39.

Water is preferably pumped into flash steam producing reservoir 13 by water pump 29 at a rate of about 20–33 cc of water per minute. As illustrated in FIG. 10, pump 29 is preferably mounted in a molded recess of housing 4 and is not integrally cast into heat/steam generator 1. Water is pumped from any number of water containers 109 to the generator via a three-part water inlet line (tube) 21, 23, 25, and 27, water pump 29, and water outlet line (tube) 35. The first part of the three-part water inlet line (tube) 21 is not encased in housing 4 and runs from water container 109 to the second part of the water inlet line (tube) 23 and 25, which is a coupling which is mounted in the rear of housing 4. Half of the coupling 23 protrudes from the housing for easy connection to the first part of the water inlet line (tube) 21. The remaining half of the coupling 25 and the third part of the water inlet line (tube) 27 are encased in the handle. The encased third part of the water inlet line (tube) 27 is connected to the remaining half of the coupling 25 at one end and water pump inlet 31 at the other end. Water is pumped through water pump 29 and exits it at water pump outlet 33 and into water outlet line (tube) 35, and thereby to flash steam reservoir nozzle 37. Water outlet line (tube) 35 is preferably not integrally cast in heat/steam generator 1. Water then enters flash steam producing reservoir 13 (cast integrally within generator 1). Generator 1 heats reservoir 13 to a temperature sufficient such that when water is pumped into reservoir 13 from water container 109, flash steam is produced. The steam then exits reservoir 13 into integrally cast steam channels 15 of generator 1, where the steam becomes superheated.

Superheated steam exits from steam channels 15 through steam exit holes 17 located at the top rear of heat/steam generator 1, down through the bottom rear of generator 1, by way of hollow protruding steam nozzles 19 and steam nozzle nipples 41, which are integrally cast with generator 1 and hold heat-resistant grommets 39. From this point, the superheated steam is routed to one of the two base unit embodiments, as described herein.

In the embodiment illustrated in FIG. 4, base unit 43 attaches parallel to the bottom of heat/steam generator 1. Base unit 43 is preferably made of a durable high-heat-conductive material similar to the body of generator 1. The length and width dimensions of base unit 43 are approximately the same dimensions as the main body of generator 1 when viewed from above. Base unit 43 is of a "lazy L" shape when viewed from the side, forming blade fence 45. Recessed holes for heat-resistant rubber grommets 47 are cast into the top rear of base unit 43. Rubber grommets 39 of generator 1 fit into the top side of base unit 43 to intimately seal the joining of generator 1 and base unit 43. Rubber grommets 39 are held into place on generator 1 by steam nozzle nipples 41 on steam nozzles 19 which are located on the rear underneath side of generator 1. Steam channels 49 are cast into base unit 43 and run length-wise inside base unit 43 from recessed grommet holes 47 to the front of base unit 43. Steam exits from the front of base unit 43 under blade 61 onto a surface to be worked upon (e.g., a wall surface). When blade 61 is mounted in base unit 43, steam channels 49 cast into base unit 43 direct the steam to the underside of blade 61, providing steam to the surface so as to assist in removal of glues, adhesives, paint, and the like.

Alternatively, as illustrated in FIGS. 5–8 and 11, blade mounting base and steam manifold 51 is attachable to heat/steam generator 1 such that a parallel portion 53 lies parallel to generator 1 and a steam manifold portion 55 lies perpendicular to generator 1. Parallel portion 53 is connected to steam manifold 55 by screws 54 and screw holes 56. Parallel portion 53 mounts to generator 1, in a manner substantially identical to that of base unit 43, and mounts parallel to generator 1. Parallel portion 53 is approximately the same length and width as generator 1 when viewed from above and is made of a durable high-heat-conductive material similar to generator 1. Parallel portion 53 is of "lazy L" shape when viewed from the side, forming blade fence 45. Steam manifold portion 55 is preferably about 9 to 12 inches wide and about 3½ to 4½ inches in length and is made of a heat-resistant material, such as a heat-resistant plastic. Mid-section gasket 57 of steam manifold portion 55 is made of material similar to that of grommets 39, and is used to seal parallel portion 53 to steam manifold portion 55. Mid-section gasket 57 of steam manifold 55 is preferably about 4½ inches wide and 3½ inches in length. Recessed holes 47 for heat-resistant rubber grommets 39 (located in the rear underside of generator 1) are cast into parallel portion 53. Rubber grommets 39 fit into the top side of parallel portion 53 to intimately seal the joining of generator 1 and blade mounting base and steam manifold 51. As previously mentioned, rubber grommets 39 are held into place on generator 1 by steam nozzle nipples 41 on steam nozzles 19 which are located on the rear underneath side of generator 1.

Steam paths 59 and steam diverters 60 in steam manifold 55 are created by casting steam-flow directional paths in the heat-resistant material. Steam flows through steam channels 15 of heat/steam generator 1 to steam exit holes 17 and then through steam nozzles 19. The steam proceeds through nipples 41 covered by grommets 39 which fit intimately into recessed grommet holes 47 and into steam nozzles 58 where the steam is directed by steam paths 59 and steam diverters 60 cast in steam manifold 55, and exits over a wide area onto the surface being worked upon. Any blade 61 is mounted on the front of parallel portion 53 of blade mounting base and steam manifold 51 in the same manner as with base unit 43. Blade mounting base and steam manifold 51 allows steam to be spread out over a wide area and to penetrate the surface to remove or decompose glue, adhesives, paint, and the like. With this embodiment, one may alternately steam and scrape without needing to set the unit aside for another unit.

Blade 61 is removably attachable, and therefore many types, shapes, and sizes of blades can be used. Blade 61 is preferably made of a durable high-heat-conductive material. The edge of blade 61 can be sharp to make it easy to scrape off the substance being removed from an object one is working on, or dull so that one does not gouge the object. The width dimension of blade 61 can be the same as the width of heat/steam generator 1 beneath which blade 61 mounts, or a smaller width. Blade 61 extends from the front of generator 1 allowing the edge of blade 61 to reach the work surface unobstructed by generator 1. When mounted in either base unit 43 or blade mounting base and steam manifold 51, the rear of blade 61 fits flush to blade fence 45. Blade 61 is placed onto either base 43 or 51 and becomes sandwiched between base 43 or 51 and generator 1 when recessed grommet holes 47 and the grommets on the rear underside of generator 1 are intimately joined together.

As illustrated in FIG. 2, to ensure that blade 61 is secure and does not move laterally when sandwiched between heat/steam generator 1 and base unit 43 or blade mounting base and steam manifold 51, the preferred embodiment comprises dowel 63 which is cast integrally with generator 1 on the underneath side of generator 1. Dowel receptacle (hole) 67 is located towards the front of blade 61. Recessed dowel receptacle 65 for dowel 63 to fit into is located in the front of both bases 43 and 51. When blade 61 is mounted in either base 43 or 51 and is sandwiched between base 43 or 51 and generator 1, dowel 63 goes through dowel receptacle 67 and securely rests in recessed dowel receptacle 65 in base 43 or 51. Base 43 or 51, blade 61, and generator 1 are further securely and intimately connected by screw 69, as earlier described, preferably a ¼-turn set screw.

Electricity is provided to heat/steam generator 1 by alternating current cord 79, preferably having a 3-prong grounded plug 81. Cord 79 enters the rear of housing 4 above water inlet line coupling 23 and 25 and connects to the electrical components mounted inside housing 4 such that the operator can heat blade 61 only, produce steam only, or heat blade 61 and produce steam. A 3-way switch 83 is disposed on the housing and wired such that the following three settings are possible: "off," "on" (heat), and "steam." When the switch is turned to "off," no electrical current flows and the unit is off. When the switch is turned to "on," the generator heats blade 61 but water pump 29 does not turn on and steam is not produced. When the switch is turned to "steam," blade 61 heats, water pump 29 turns on, and generator 1 produces steam. Without blade 61 attached, generator 1 still produces steam when the switch is in the "steam" position. The other electrical components within housing 4 are heater 5 cast into generator 1, water pump 29, and heat-sensitive temperature controlling device 87. Heat-sensitive temperature controlling device 87, which is commercially available, fits in receptacle 89 which is cast in the top side of generator 1 and in hole 113 in cover plate 91, towards the rear of both, and has two mounting tabs 88 to securely fasten it within receptacle 89 by screws 84. Heat-sensitive temperature controlling device 87 regulates the amount of electrical current flowing through the heating unit, and thus the amount of heat generated, by means of insulated wires (not shown) connected to electrical connectors 86.

Cover plate 91, preferably made of stainless steel, is a part of and covers the top side of heat/steam generator 1. Water outlet line (tube) 35 from water pump 29 to flash steam reservoir nozzle 37 runs above cover plate 91. Reservoir nozzle 37 is attached to the top of cover plate 91, which is attached to generator 1 by several screws 97, plate screw holes 93, and screw holes 95 located on the top side of generator 1. Cover plate 91 is preferably sealed to generator 1 with heat-resistant sealant/adhesive (not shown).

Figure 9:
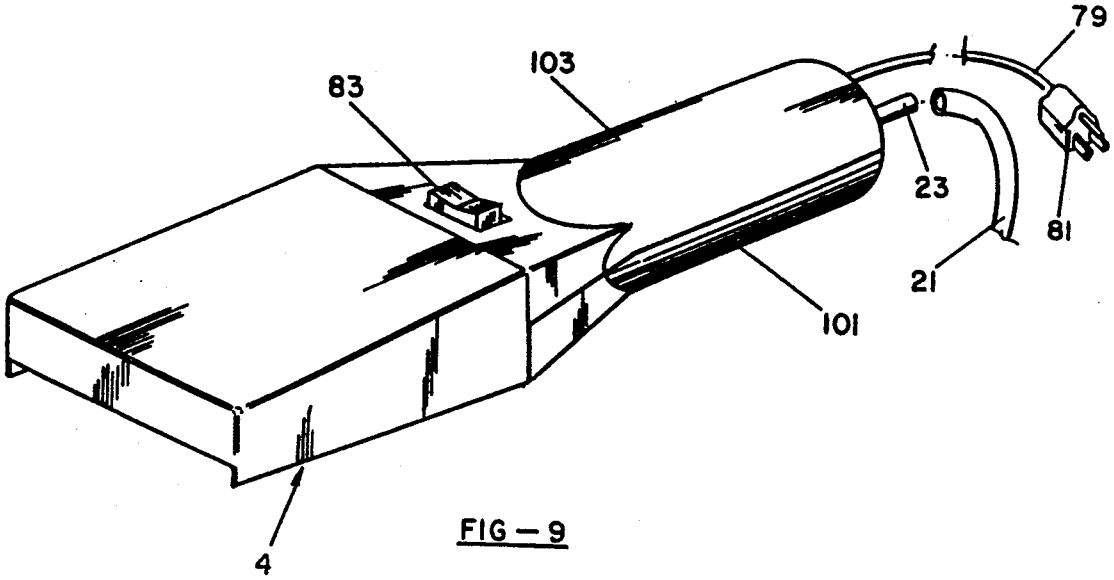
FIG. 9 is a perspective view of the preferred embodiment without a heat/steam generator, blade or base attached.

Housing 4 is preferably made of heat resistant material (plastic) and comprises two main parts, as illustrated in FIGS. 1 and 9. Bottom half 101 of housing 4 provides a bottom portion of a handle and houses from the bottom the rear portion of water inlet line (tube) coupling 25 and the third part of water inlet line (tube) 27, covers mounting prongs 3 protruding from the rear of generator 1, and houses electrical connectors and insulation. Water pump 29 rests in bottom half 101 and is located between two mounting prongs 3. Top half 103 of housing 4 serves two purposes: it covers generator 1 and all of the components attached to generator 1, including cover plate 91 and water outlet line (tube) 35; and it houses from the top rear portion of the water inlet line (tube) coupling 25 and the third part of water inlet line (tube) 27, covers mounting prongs 3 protruding from the rear of the generator, and houses electrical connectors and insulation. Switch 83 is preferably located in top half 103 of the housing. Screw holes 105, preferably four in number, in two mounting prongs 3 protruding rearward from generator 1 permit attachment of housing 4 to generator 1 by screws 107 and screw holes in housing 4 (not shown).

The single unit of the present invention substantially removes the need to have the following wide variety of prior art tools on hand: wallpaper removers; putty knives and unheated scrapers; heat guns; paint, glue, and/or adhesive-removing chemicals; heated scrapers; and powered paint scrapers. Furthermore, because water is not stored within the unit, but rather in a separate water container(s), the unit is not weighty, may be wielded with one hand, and can provide steam without need for frequent refillings.

EXAMPLES (INDUSTRIAL APPLICABILITY)

The invention is further illustrated by the following non-limiting examples of home and industrial uses of the preferred embodiment:

1. Remove paint from homes (trim, windows, garage doors), eliminating the need for toxic chemicals.
2. Remove paint or finish from furniture.
3. Remove wallpaper or shelving paper or glued-down material.
4. Remove glued down floor coverings (vinyl tile, linoleum, tar-backed floor tile).
5. Remove linoleum on kitchen or bathroom counters.
6. When building cabinets or furniture, change the design or mend a mistake without ruining the furniture or cabinet (i.e., remove glued-on pieces without burning or gouging the main piece of furniture or cabinet).
7. Remove caulking.
8. Remove paint from metal surfaces.
9. Cut of plastics and carpets.
10. Remove existing shelving in kitchen cabinets without ruining the existing base (frame).
11. Remove appliques from furniture, walls, cabinets, and the like.

Although the invention has been described with reference to these preferred embodiments, other embodiments can achieve the same results. Variations and modifications of the present invention will be obvious to those skilled in the art and it is intended to cover in the appended claims all such modifications and equivalents.

We claim:

1. A heated scraper and steamer apparatus comprising:

a housing;

a heat conductive blade;

means for producing heat and steam within said housing, said heat and steam producing means being capable of selectively producing heat only or heat and steam simultaneously;

means for attaching said heat conductive blade to said apparatus;

means for conducting steam produced by said heat and steam producing means to a work surface; and means for conducting heat to said blade and to the work surface via said blade.

2. The heated scraper and steamer apparatus of claim 1 additionally comprising a three-way switch disposed on said housing and electrically connected to said heat and steam producing means, whereby said heat and steam producing means is settable to a first position to turn off the apparatus, settable to a second position to provide heat only, and settable to a third position to provide heat and steam simultaneously.

3. The heated scraper and steamer apparatus of claim 1 additionally comprising a water pump disposed within said housing and operably connected to said heat and steam producing means and to a water supply external to said housing.

4. The heated scraper and steamer apparatus of claim 1 wherein said heat and steam producing means comprises means for superheating steam.

5. The heated scraper and steamer apparatus of claim 1 wherein said heat and steam producing means comprises means for regulating temperature of said heat and steam producing means.

6. The heated scraper and steamer apparatus of claim 1 wherein said steam conducting means is disposed within said blade attaching means.

7. The heated scraper and steamer apparatus of claim 1 wherein said steam conducting means conducts steam parallel to the longitudinal dimension of and to a point near an end of said housing.

8. The heated scraper and steamer apparatus of claim 1 wherein said steam conducting means conducts steam in a plurality of directions from the underside of said housing.

9. The heated scraper and steamer apparatus of claim 1 additionally comprising means for preventing motion of the blade attached to said apparatus by said blade attaching means.

10. The heated scraper and steamer apparatus of claim 9 wherein said motion preventing means comprises a dowel attached to said heat and steam producing means.

* * * * *